United States Patent [19]

Ehrman

[11] Patent Number: 4,841,882

[45] Date of Patent: Jun. 27, 1989

[54] ARTICLES OF FOLDABLE FURNITURE

[76] Inventor: Ernest W. Ehrman, 444 E. 82nd St., New York, N.Y. 10028

[21] Appl. No.: 233,587

[22] Filed: Aug. 18, 1988

[51] Int. Cl.[4] ..... A47B 3/00

[52] U.S. Cl. ..... 108/115; 108/153; 428/542.8; 297/442

[58] Field of Search ..... 108/111, 115, 153; 428/542.8; 229/108, 109, 110; 297/440, 442; 248/174

[56] References Cited

U.S. PATENT DOCUMENTS

| | | | |
|---|---|---|---|
| 695,211 | 3/1902 | Keller | 229/109 |
| 2,141,399 | 12/1938 | Luhn | 108/115 |
| 2,390,546 | 12/1945 | Mather | 108/115 |
| 2,822,860 | 2/1958 | Calabrese | 108/115 |
| 3,220,362 | 11/1965 | Downes | 108/115 |
| 3,438,345 | 4/1969 | Lasaine et al. | 108/115 |
| 3,592,143 | 7/1971 | Krone | 108/115 |
| 3,892,441 | 7/1975 | Roeshman | 297/442 |
| 4,304,329 | 12/1981 | Graser | 229/109 |
| 4,546,941 | 10/1985 | Hildebrand | 108/153 |

FOREIGN PATENT DOCUMENTS

| | | | |
|---|---|---|---|
| 920558 | 2/1973 | Canada | 229/110 |

*Primary Examiner*—Kenneth J. Dorner
*Assistant Examiner*—Brian K. Green
*Attorney, Agent, or Firm*—Cohen, Pontani & Lieberman

[57] ABSTRACT

A foldable article of furniture which can be formed in its entirety from a single, unitary sheet of material without the use of supplemental securement members or fasteners such as staples or glue. The furniture article has three or more legs for stability and support. Additionally, each of the legs is interlocked with adjoining legs and is also integral with a top portion of the furniture along a common peripheral edge. The flat sheet or blank may be provided with stress relief openings and with prescored fold lines to facilitate assembly of the article.

6 Claims, 4 Drawing Sheets

ARTICLES OF FOLDABLE FURNITURE

FIELD OF THE INVENTION

The present invention relates to articles of foldable furniture, such as tables or stools, constructed from a single, unitary flat sheet of paper, cardboard or corrugated cardboard and the like. The invention also relates to flat sheets or blanks of paper, cardboard or corrugated cardboard and the like which are scored or marked along predetermined fold lines and which are configured for ready folding into articles of furniture such as tables or stools.

BACKGROUND OF THE INVENTION

Various types of collapsible furniture are known in the art. U.S. Pat. No. 2,361,875, for example, discloses a stool of one-piece construction which may be folded from a single flat sheet of material. To form the article, a first portion of the sheet is folded to form a triangular pedestal; two other, identical portions are then folded over the pedestal in interlocking relationship therewith to retain the pedestal in its folded configuration.

However, the design according to U.S. Pat. No. 2,361,875 has several disadvantages. The base or pedestal is held together only through engagement of interlocking tabs of the seat portions on a top end thereof. There is no integral structure for holding together the lower end of the base. Additionally, there is very little support provided by the base around the perimeter of the seat. This makes the stool undesirably unstable and easy to tip over and, in addition, renders the seat easily and unexpectedly deformable under the weight of a person or child sitting thereon.

Another type of known foldable stool is disclosed in U.S. Pat. No. 2,390,546. However, this prior art stool has the disadvantage of requiring the use of staples in its assembly. This stool does offer a slight improvement over the article of U.S. Pat. No. 2,361,875 in that it includes two, instead of only one, triangular support pedestals or legs. However, it suffers a similar disadvantage with the stool of U.S. Pat. No. 2,361,875 in that both leave large portions of the seat (i.e. about 50% or more) unsupported and, thus, relatively easily deformable when one attempts to sit on the stool, especially if the articles are formed of a relatively lightweight material such as reinforced paper or cardboard.

A substantially safer and more practical design for a foldable stool is illustrated in my U.S. Design Pat. No. Des. 236,673. The stool therein disclosed has an octagonal seat with four box-like legs for support. Not only is the seat better supported with this design but it is far less likely to tip over under load. This design, however, is of two piece construction. Thus, as shown in FIG. 3 of U.S. Design Pat. No. 236,673, a second member is employed to interlock with notches in each of the four legs of the stool and thereby retain the stool in its folded or assembled condition.

A need therefore exists for a safe, sturdy, lightweight, foldable stool which can be formed in its entirety from a single, unitary sheet of material without the use of supplemental securement members or fasteners such as staples or glue. Furthermore, a need exists for a foldable stool or table which can be made from lightweight materials, such as paper, cardboard or corrugated cardboard and the like, while having good stability and strength against deformation under normal load conditions.

SUMMARY OF THE INVENTION

According to the present invention, articles of foldable furniture which may be used as stools or tables are formed by predetermined folding of a single, unitary, specially-configured sheet of material such, for example, as of paper, cardboard, or corrugated cardboard and the like. The furniture article according to the invention has three or more legs for stability and support. Additionally, each of the legs is interlocked with adjoining legs and is also integral with a top portion of the furniture along a common peripheral edge thereof. The flat sheet or blank may be provided with stress relief openings and with pre-scored fold lines to facilitate assembly of the article in accordance with the invention.

BRIEF DESCRIPTION OF THE DRAWINGS

The invention will now be described with reference to the accompanying drawings which illustrate preferred embodiments of the invention but which, however, are not intended to be construed as limiting the scope of the invention to those specific embodiments illustrated herein. In the drawings, wherein like numerals indicate like elements throughout the several views.

DETAILED DESCRIPTION OF THE PREFERRED EMBODIMENTS

The present invention relates to collapsible or foldable furniture which is constructed from a single, unitary sheet of material (e.g. of paper, cardboard, or corrugated cardboard and the like) without the use of adhesives, staples, or other separate fastening members or means. The furniture according to the present invention is preferably constructed from single, unitary, initially flat, precut and specially-configured blanks, preferably but not necessarily of paper, cardboard, corrugated cardboard and like foldable materials. A blank as described herein may accordingly be shipped in a flat package to the end user who may then fold the blank into the desired article of furniture.

Figure 1:
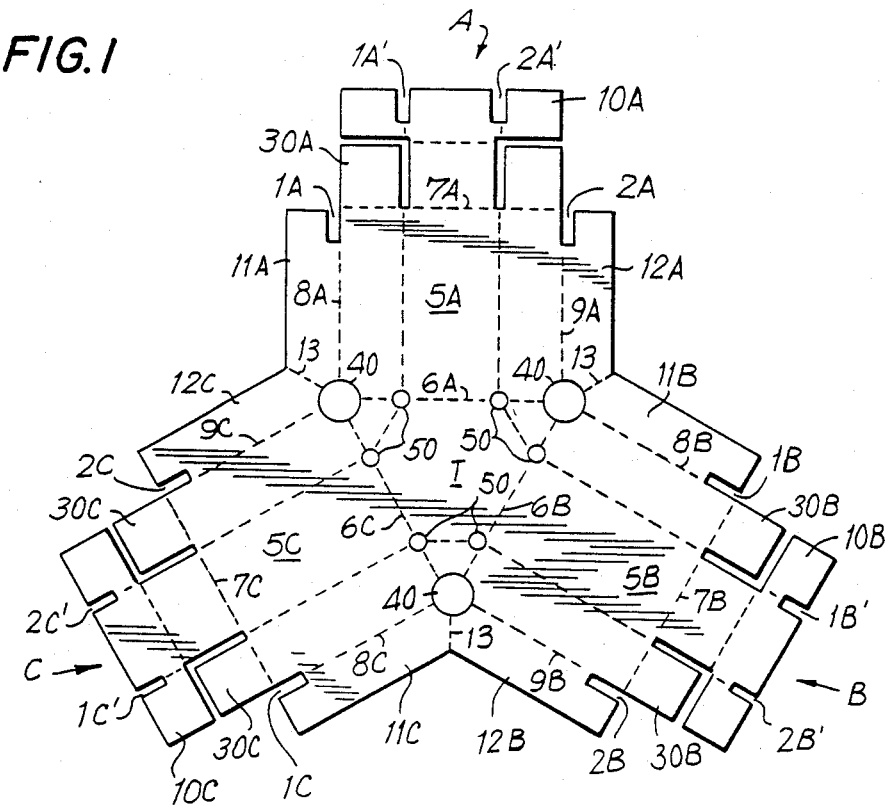
FIG. 1 is a top plan view of a blank for a three-legged stool or table in accordance with the invention.

With reference to FIG. 1, a blank for a three-legged stool or table is shown. The unitary blank consists of three panels A, B and C which, when folded, will comprise the three legs of the resulting stool or table. The panels A, B and C are each integrally attached along an edge thereof to and project radially outwardly from a central portion or top T having six sides. When the blank has been folded as described hereinbelow, the top T will comprise a tabletop or, alternatively, the seat of a stool.

As illustrated in FIG. 1, each of the panels A, B and C is identical. However, as should be apparent to those skilled in the art numerous variations on the specific panel configurations and constructions illustrated may be made without departing from the spirit and scope of the invention as disclosed herein.

With specific reference to FIG. 1, each of the panels A, B, C comprises a region 5 having a first edge 6 which is contiguous with the central portion T of the blank. In the nomenclature used throughout this disclosure, panel A has a region 5A, panel B has a region 5B, and panel C has a region 5C. The region 5 also includes a second edge 7 disposed substantially parallel to the first edge 5, and two sides edges 8, 9. As will hereinafter become apparent, the region 5 is foldable along the first edge 6 relative to the central portion T of the blank.

Each panel A, B, C further comprises a lock flap 10 which extends from the second edge 7 of the region 5.

Each of the lock flaps 10A, 10B and 10C has, in turn, two lock notches 1', 2'. Lock flap 10A has lock notches 1A' and 2A', lock flap 10B has lock notches 1B' and 2B', and lock flap 10C has lock notches 1C' and 2C'. Each of the panels A, B and C may further include two optional fold-over flaps 30A, 30B, and 30C, respectively.

Each panel A,B, C further comprises a pair of members 11, 12, each depending from a respective one of the side edges 8, 9 of the region 5 and sharing a common edge 13 with one of the members of an adjacently-disposed one of the panels A, B, C. Thus, for example, the member 11A of panel A shares a common edge 13 with the member 12C of panel C and member 12A shares a common edge 13 with the member 11B of panel B. The adjacently-disposed members—such, for example, as the members 11A, 12C and the members 12A, 11B—are relatively foldable about their respective shared common edge 13.

Each member 11, 12 further comprises a notch 1, 2, respectively. Thus, in panel A the member 11A has a notch 1A and the member 12A has a notch 2A. Similarly, the members 11B, 12B of panel B have notches 1B, 2B, and the members 11C, 12C of panel C have notches 1C, 2C. These notches 1, 2 are engageable in the folded configuration of the blank for concurrent interlocking relationship with one of the respective lock notches 1', 2' of the same panel and with one of the respective lock notches 2', 1' of an adjacently-disposed panel. Thus, by way of example, the notch 1A is engageable, in the folded configuration of the blank, for concurrent interlocking relation with lock notch 1A' of panel A and with the lock notch 2C' of the adjacently-disposed panel C.

In order to facilitate folding of the blank and further maintain its structural integrity a plurality of stress relief holes may be defined in the blank. These may include large stress relief holes 40 and relatively smaller stress relief holes 50 which are positioned about the periphery of the top T. The size of the stress relief holes is not important except, perhaps, from an aesthetic standpoint.

Figure 2:
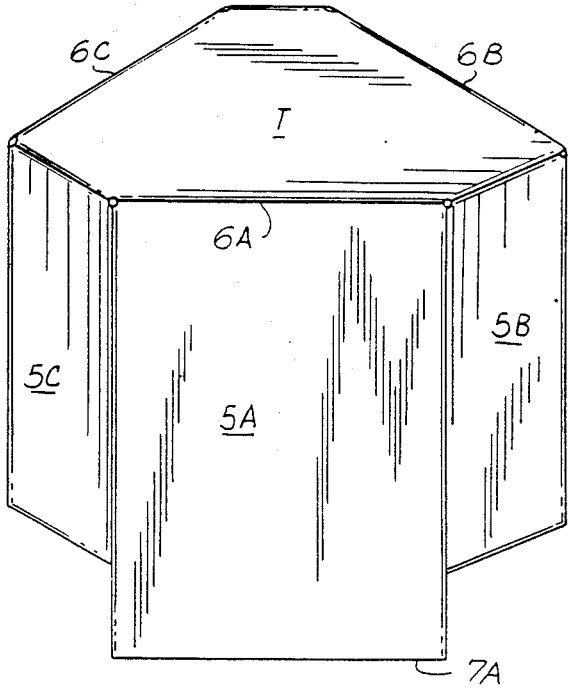
FIG. 2 is a perspective view of a three-legged stool or table formed from the blank illustrated in FIG. 1.

The blank shown in FIG. 1 may be readily folded into the stool or table illustrated in FIG. 2. The manner in which the blanks may be folded into a stool or table according to the present invention will be described in detail below.

Figure 3:
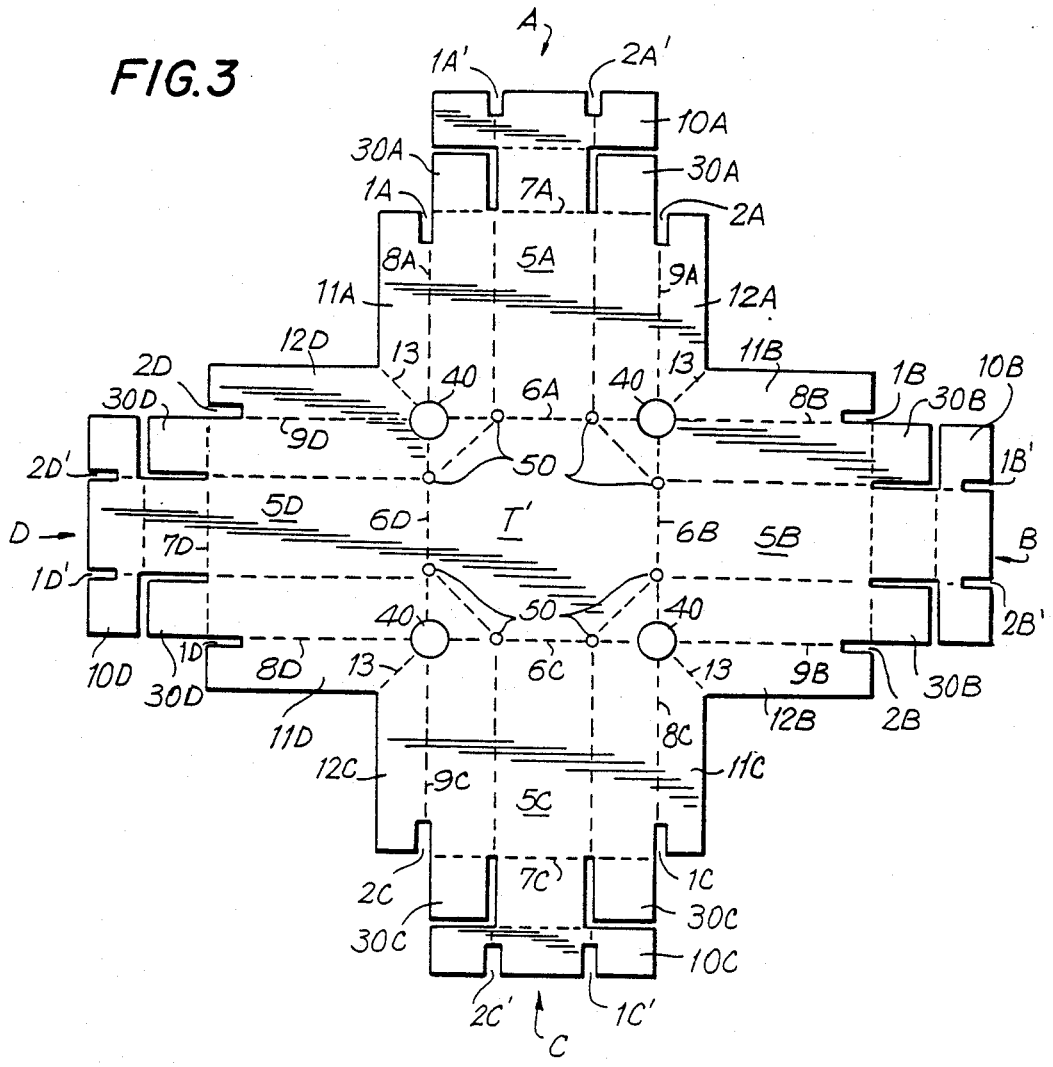
FIG. 3 is a top plan view of a blank for a four-legged stool or table in accordance with the invention.

FIG. 3 depicts another embodiment of the invention—namely, a blank for a four-legged stool or table. This is currently the most preferred form of the invention.

As illustrated in FIG. 3, the blank comprises four panels A, B, C and D. Each of the panels A, B, C and D is configured in a manner similar to the three panels A, B and C of the three legged stool of FIGS. 1 and 2. The blank of FIG. 3 differs from that of FIG. 1, however, in that the blank of FIG. 3 includes a fourth panel D for forming a fourth leg. In addition, in the blank of FIG. 3 the top T' has eight peripheral sides or edge portions for accommodating four legs. Otherwise the individual elements (notches, lock flaps and lock notches) of the panels A, B, C, and D forming the legs of the resulting furniture article are substantially the same as those of the three panels A, B, and C of the blank shown in FIG. 1.

Figure 4:
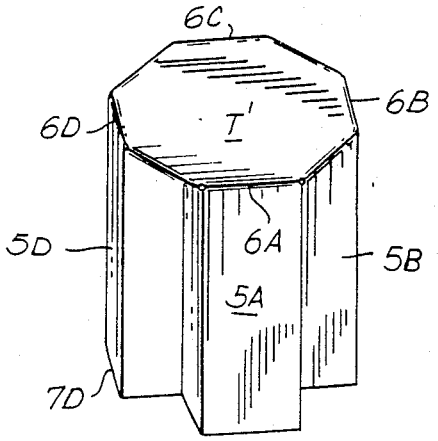
FIG. 4 is a perspective view of a four-legged stool or table constructed from the blank illustrated in FIG. 3.

The blank of FIG. 3 may be folded in a manner described hereinbelow into a four legged stool or table such as that illustrated in FIG. 4.

Figure 5:
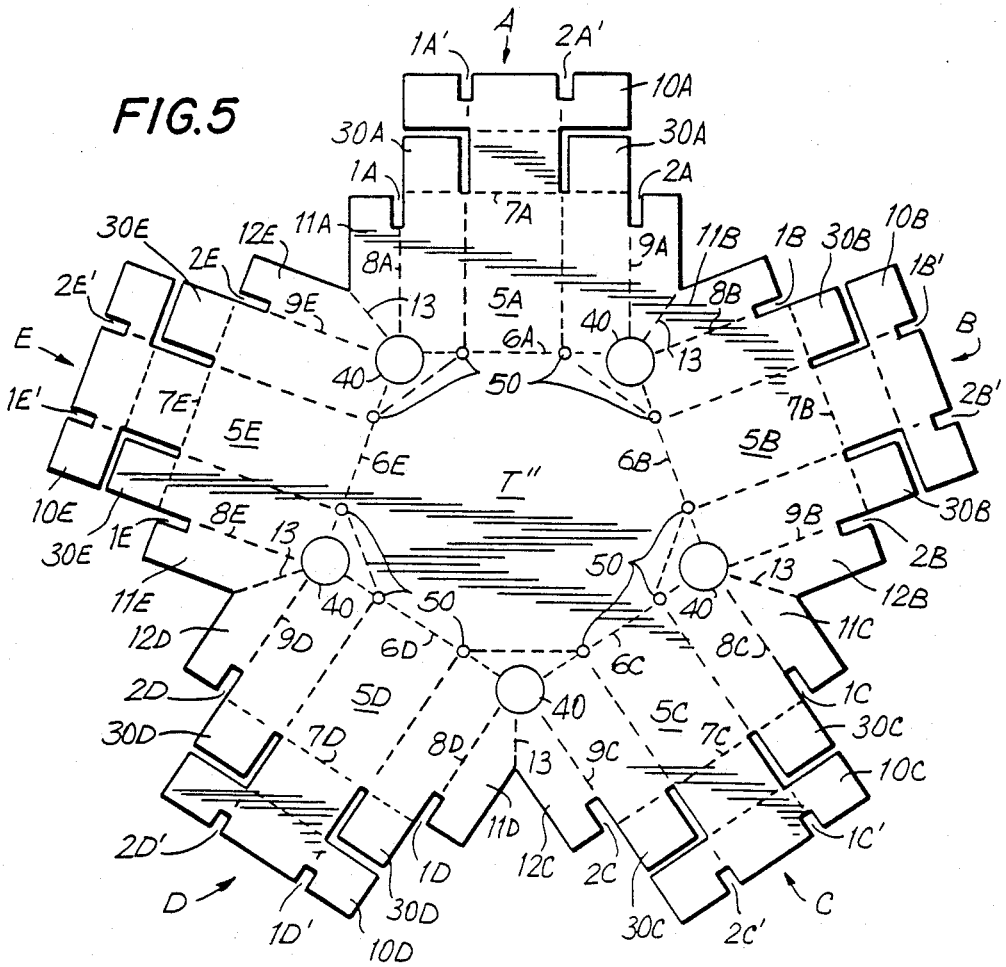
FIG. 5 is a top plan view of a blank for a five-legged stool or table in accordance with the invention.
Figure 6:
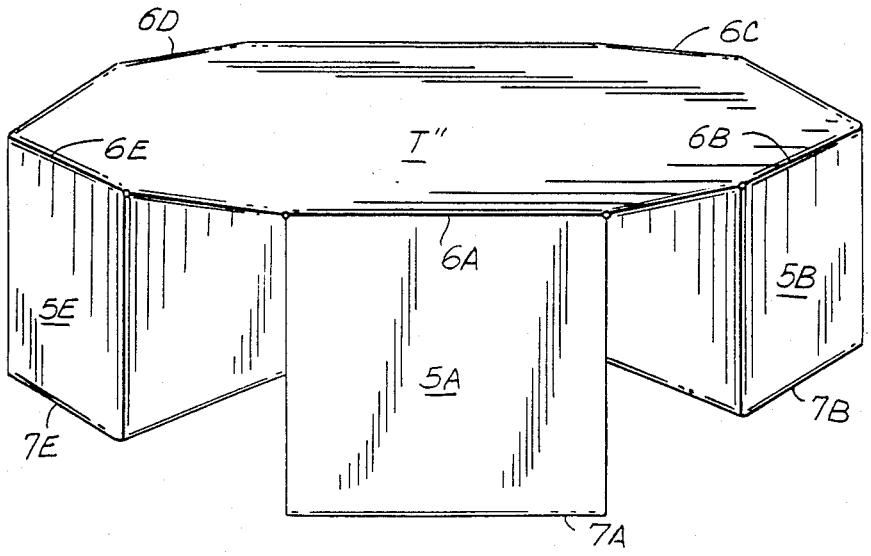
FIG. 6 is a perspective view of a five-legged stool or table constructed from the blank illustrated in FIG. 5.

FIG. 5 illustrates yet another embodiment of the invention. In FIG. 5, the blank is foldable for forming a five-legged stool or table. Thus, the five panels A, B, C, D and E in the blank of FIG. 5 correspond to the five legs of a folded stool or table formed from the blank. The panels A, B, C, D and E are constructed in substantially the same manner as each of the panels of the blanks of FIGS. 1 and 3 described hereinabove. In the blank of FIG. 5, however, the top T" has ten peripheral sides or edge portions and the blank is foldable into a five-legged stool or table such as is illustrated in FIG. 6.

A currently contemplated procedure for folding a unitary blank formed in accordance with the present invention into a stool or table will now be described with particular reference to FIGS. 7A through 7D in which, for purposes of illustration, the four-panel blank of FIG. 3 is depicted. This folding procedure may also be used, with only minor variations or modifications which will be apparent to persons having ordinary skill in the art, to form from the appropriate blanks stools or tables having any number of legs.

Figure 7A:
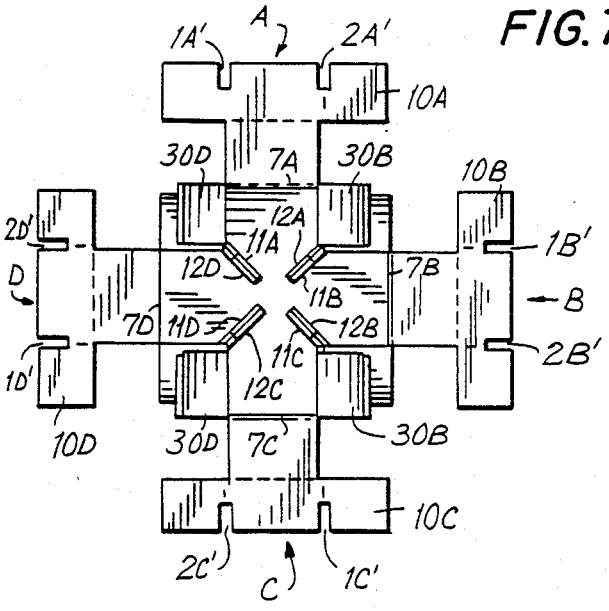
FIGS. 7A through 7D sequentially illustrate a method of constructing the four-legged table illustrated in FIG. 4 from the blank shown in FIG. 3.
Figure 7B:
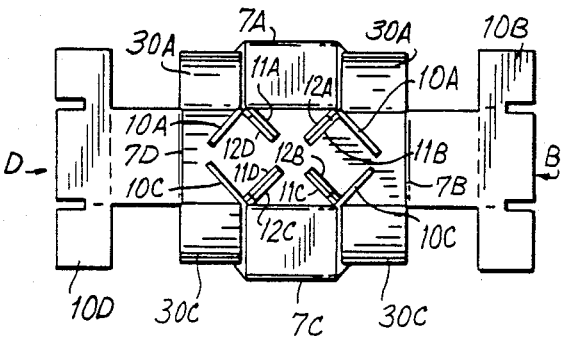

Turning now to FIG. 7A, the blank of FIG. 3 is shown partially folded so that the various aforedescribed members and notches of the four panels A, B, C and D have been brought into abutting relationship with the notches of adjacently-disposed members in alignment or registry with one another. As depicted in FIG. 7A, members. 12A and 11B have been brought together into substantial abutment so that their notches 2A and 1B positionally coincide and adjacently overlap. Similarly, members 12B and 11C of panels B and C have been brought together into substantial abutment, as have members 12C and 11D of panels C and D and members 12D and 11A of panels D and A. Next, as shown in FIG. 7B, lock flap 10A of panel A has been folded over and its lock notches 1A' and 2A' have been inserted over and into engagement with the overlapping or coinciding notches 1A, 2D and 2A, 1B, respectively. In like manner, lock flap 10C has been folded over and its lock notches 1C' and 2C' have been inserted over and into engagement with the overlapping or coinciding notches 2B, 1C and 2C, 1D, respectively.

Figure 7C:
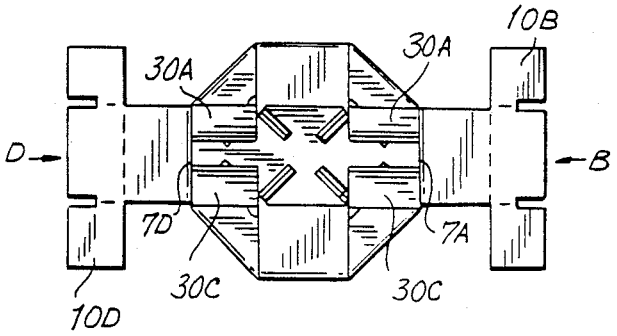

Next, as depicted in FIG. 7C, the fold-over flaps 30B and 30D of panels B and D have been folded over the ends of lock flaps 10A and 10C.

Figure 7D:
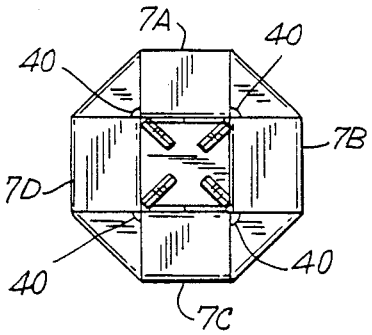

Finally, as illustrated in FIG. 7D, lock flaps 10B and 10D have been folded over and their lock notches inserted over and into engagement with the corresponding lock notches. As can be seen in FIG. 7D, which is a view from the underside or bottom of the assembled stool or table, the panels A, B, C and D have been folded into and define mutually interlocking box-like legs.

It will of course be appreciated that minor variations in the sequence of the folding operation illustrated in FIGS. 7A through 7D may be utilized without departing from the spirit and scope of the invention.

As should be further understood, a minimum of three legs is preferred in accordance with the invention in order to provide good stability and support, although any number of legs can be employed. By way of example, blanks for folding stools having three, four and five legs have been illustrated herein. In like manner, stools, tables or other articles of furniture having more than five legs can be formed from unitary, single sheet blanks in accordance with the invention.

To ease the folding operation, the blanks may be marked and, optionally, pre-scored along their intended fold lines. Such fold lines are depicted by the dotted lines in FIGS. 1, 3 and 5. Also, as shown, it is preferred that the blanks include stress relief holes 40 and 50 at points where the fold lines intersect about the periphery of the tops T, T′ and T″ of FIGS. 1, 3, and 5, respectively.

Thus, as shown and described herein, the invention provides novel folded articles of furniture which may be produced by appropriate folding of unitary, single sheet blanks. The furniture is lightweight and sturdy making it ideally suited for use by children. In addition the blanks, with optional pre-marked and/or pre-scored fold lines and stress-relief holes, are simple and easy to fold into the resulting article yet, when the legs are respectively and mutually interlocked, provide strong and secure support for a user of the article.

While there have been shown and described and pointed out fundamental novel features of the invention as applied to several currently preferred embodiments thereof, it will be understood that various omissions and substitutions and changes in the form and details of the devices illustrated and in their operation may be made by those skilled in the art without departing from the spirit of the invention. It is the intention, therefore, to be limited only as indicated by the scope of the claims appended hereto.

What is claimed is:

1. A unitary blank having an initial unfolded configuration in the form of a substantially flat sheet and manipulatable to convert said flat sheet to a folded configuration in which said unitary blank self-interlocking by forms a complete assembled article of furniture having a flat top and at least three legs, said blank comprising:

(a) a central portion for defining the article top and having a peripheral edge; and (b) at least three panels which project radially outwardly from said central portion of said blank in its initial unfolded configuration, each said panel defining a leg of said article in the folded configuration of said blank and comprising (i) a region having a first edge contiguous with said peripheral edge of said central portion of the blank, a second edge disposed substantially parallel to said first edge, and two side edges, said region being foldable along said first edge relative to said central portion of the blank, (ii) a lock flap extending from said second edge of said region, said lock flap having at least two lock notches and being foldable along said second edge relative to said region, and (iii) a pair of members, each said member extending from a respective one of said side edges and sharing a common edge with one of said members of an adjacently-disposed one of said panels, adjacently-disposed ones of said members being relatively foldable about said shared common edge, each said member further comprising a notch engageable, in the folded configuration of said blank, for concurrent interlocking relationship with one of said lock notches of the respective panel and with one of said lock notches of an adjacently-disposed one of said panels;

whereby to convert said blank from said initial unfolded configuration to said folded configuration each of said regions is folded relative to said central portion along said first edge to bring adjacently-disposed ones of said members into substantial abutment and said notches of said adjacently-disposed members into substantial relative abutment, and each said lock flap is folded relative to said region along said second edge and so that each said lock notch is received in interlocking engagement with said notch of at least an adjacently-disposed one of said panels, each of said legs thus formed from said panels being thereby interlocked one to another so that said unitary blank self-interlockingly defines a complete assembled article of furniture.

2. The blank according to claim 1, further comprising pre-marked fold lines along one or more of said central portion peripheral edge and said panels.

3. The blank according to claim 2, further comprising a plurality of stress relief holes defined in said blank about the periphery of said central portion at points of intersection of two or more of s id fold lines on said blank.

4. The blank according to claim 1, further comprising pre-scored fold lines along one or more of said central portion peripheral edge and said panels.

5. The blank according to claim 4, further comprising a plurality of stress relief holes defined in said blank about the periphery of said central portion at points of intersection of two or more of said fold lines on said blank.

6. The blank according to claim 1, wherein the blank is formed from a material selected from the group consisting of paper, cardboard or corrugated cardboard.

* * * * *